US005780822A

United States Patent [19]

Lee

[11] Patent Number: 5,780,822

[45] Date of Patent: Jul. 14, 1998

[54] APPARATUS AND METHOD FOR COOLING THERMOPILE OF MICROWAVE OVEN

[75] Inventor: Geun Hyoung Lee, Kyungsngnam-do, Rep. of Korea

[73] Assignee: LG Electronics Inc., Rep. of Korea

[21] Appl. No.: 650,805

[22] Filed: May 20, 1996

[30] Foreign Application Priority Data

Nov. 28, 1994 [KR] Rep. of Korea ..... 1994 31532

[51] Int. Cl.[6] ..... H05B 6/68

[52] U.S. Cl. ..... 219/710; 219/711; 219/757; 374/149

[58] Field of Search ..... 219/710, 711, 219/712, 757; 374/149

[56] References Cited

U.S. PATENT DOCUMENTS

| | | | |
|---|---|---|---|
| 3,875,361 | 4/1975 | Fukui et al. | 219/710 |
| 4,115,678 | 9/1978 | Tachikawa et al. | 219/757 |
| 4,286,134 | 8/1981 | Nakata et al. | 219/711 |
| 4,608,474 | 8/1986 | Kohka | 219/757 |
| 4,886,046 | 12/1989 | Welch | 219/757 |

FOREIGN PATENT DOCUMENTS

| | | | |
|---|---|---|---|
| 1 196 968 | 11/1985 | Canada | 219/757 |
| 3-247920 | 11/1991 | Japan | 219/711 |
| 6-34145 | 2/1994 | Japan | 219/757 |

*Primary Examiner*—Philip H. Leung

*Attorney, Agent, or Firm*—Ostrolenk, Faber, Gerb & Soffen, LLP

[57] ABSTRACT

An apparatus and method for cooling a thermopile of a microwave oven which is capable of achieving a desired automatic cooking operation by effectively preventing the thermopile from being heated beyond a predetermined level irrespective of the change of the temperature of a heating chamber, wherein the apparatus includes a cooling fan provided at a bottom portion of an electrical components mounting compartment, an air duct provided above the cooling fan for selectively guiding outside air drawn in by the rotation of the cooling fan through a suction inlet to flow either to the inside of the electrical components mounting compartment, or to an upper portion of a heating chamber, and cooling air flow guides attached on the upper surface of the heating chamber, for guiding the cooling air flowing to the upper portion of the heating chamber to be moved towards a thermopile thereat.

7 Claims, 5 Drawing Sheets

APPARATUS AND METHOD FOR COOLING THERMOPILE OF MICROWAVE OVEN

BACKGROUND OF THE INVENTION

1. Field of the Invention

The present invention relates to an apparatus for cooling a thermopile of a microwave oven and to a method therefor, and in particular to an improved apparatus and method for cooling a thermopile of a microwave oven which are capable of achieving a desired automatic cooking operation by effectively preventing the thermopile from being heated beyond a predetermined level irrespective of a change in the temperature in a cooking chamber.

2. Description of the Conventional Art

As shown in FIG. 1, a conventional microwave oven has a cubic-shaped main body 10 having a door 2 hingedly engaged to a front portion of the main body 10 so as to open/close a heating chamber 7 formed within the main body 10.

A control panel 3 is disposed at a front surface of the main body 10 to the right of the door 2 for controlling the cooking state of a foodstuff(not illustrated) placed in the heating chamber 7.

An electrical component mounting compartment is formed in the main body 10 behind the control panel 3 and at one side of the heating chamber 7.

A magnetron 6, a high voltage transformer 5, and a cooling fan 8 for cooling the magnetron 6 and the high voltage transformer 5 are provided within the electrical component mounting compartment 9.

In the drawings, reference numeral 1 denotes a casing, and 4 denotes a fan motor housing.

The operation of the conventional microwave oven will now be described in detail with reference to the accompanying drawings.

First, when a foodstuff is put in the heating chamber 7 and a desired cooking menu is selected on the control panel 3, the magnetron 6 or a heater 16 disposed in the heating chamber starts to be operated for cooking.

Then, in accordance with an operation of the motor of the cooling fan 8 and rotation of a fan blade thereof(not illustrated), air is drawn from outside into the electrical component mounting compartment 9, for thereby cooling the magnetron 6 and the high voltage transformer 5, and thus overheating of the same is prevented.

But, in the above-mentioned conventional microwave oven, when a foodstuff is cooked in accordance with a heating operation of the heater 16, the temperature at an upper portion within the heating chamber 7 becomes increased.

Therefore, it is difficult to mount a thermopile at the upper portion of the heating chamber 7 because the thermopile has a characteristic that when the temperature at a peripheral portion of the same exceeds about 100° C. a desired performance of the thermopile can not be obtained. Here, the thermopile is generally adapted to measure the intensity of infrared ray generated upon heating a food, and thereby detect the cooking state of the foodstuff, thus achieving an automatic cooking operation of the microwave oven.

SUMMARY OF THE INVENTION

Accordingly, it is an object of the present invention to provide an apparatus and method for cooling a thermopile of a microwave oven, which overcome the problems encountered in the conventional apparatus.

It is another object of the present invention to provide an improved apparatus and method for cooling a thermopile of a microwave oven, which includes a cooling fan provided at a bottom portion of an electrical component mounting compartment in the microwave oven, an air duct provided above the cooling fan, for selectively guiding outside air drawn in by the rotation of the cooling fan through a suction inlet to the inside of the electrical component mounting compartment, or to an upper portion of a heating chamber, and a cooling air flow guide provided on the upper surface of the heating chamber, for guiding cool air flowing in to the upper portion of the heating chamber toward the thermopile.

To achieve the above object, there is provided an apparatus for cooling a thermopile of a microwave oven, which includes the steps of; when a temperature around the thermopile is detected to exceed a predetermined level rotating a cooling fan motor at a higher than normal speed to direct a larger than normal volume of cooling air to the thermopile, and when the temperature around the thermopile is detected to be below the predetermined level, rotating the cooling fan motor at the normal speed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will now be described in detail with reference to the accompanying drawings.

Figure 1:
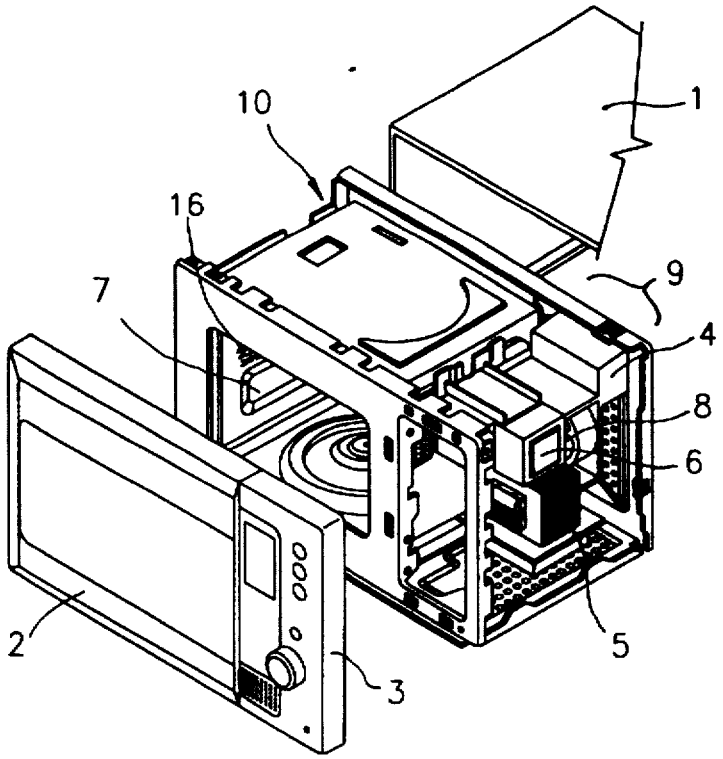
FIG. 1 CONVENTIONAL ART
FIG. 1 is an exploded perspective diagram showing the inner construction of a conventional microwave oven.
Figure 2:
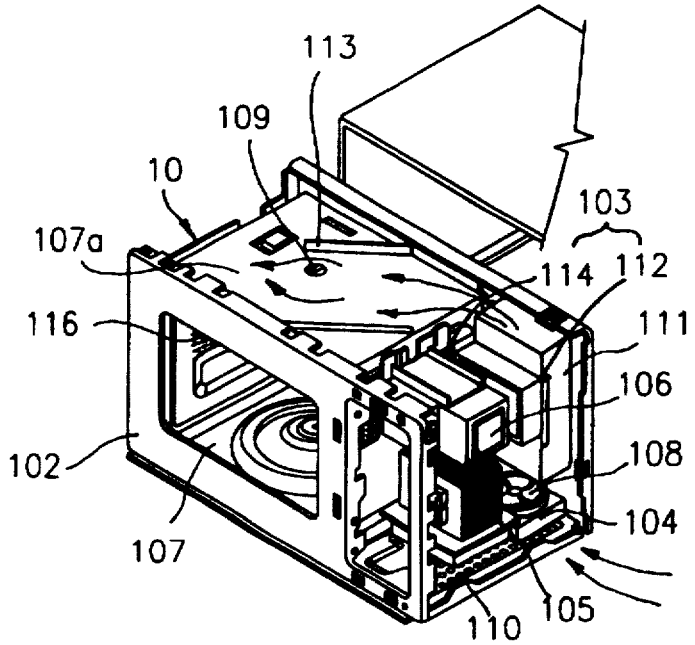
FIG. 2 is an exploded perspective diagram showing the inner construction of a microwave oven according to the present invention.

As shown in FIG. 2, the apparatus for cooling a thermopile of a microwave oven according to the present invention is adapted to a microwave oven which has a main body 100 having a door opening 102 in a front portion of the main body 100 defining a front opening of a heating chamber 107 formed within the main body 100.

A control panel opening(not illustrated) is provided at a side of the door opening 102 for mounting a control panel for controlling a condition of the microwave oven for cooking a foodstuff(not illustrated) contained in the heating chamber 107.

A heater 116 is disposed in an upper portion within the heating chamber 107 for heating foodstuffs placed therewithin, and a thermopile 109 is mounted on the upper central surface of an upper metal plate 107*a* of the heating chamber 107.

An electrical component mounting compartment 103 which accommodates a magnetron 106 for generating cooking energy and a high voltage transformer 105 is defined at one side portion of the main body next to the heating chamber 107.

Figure 3:
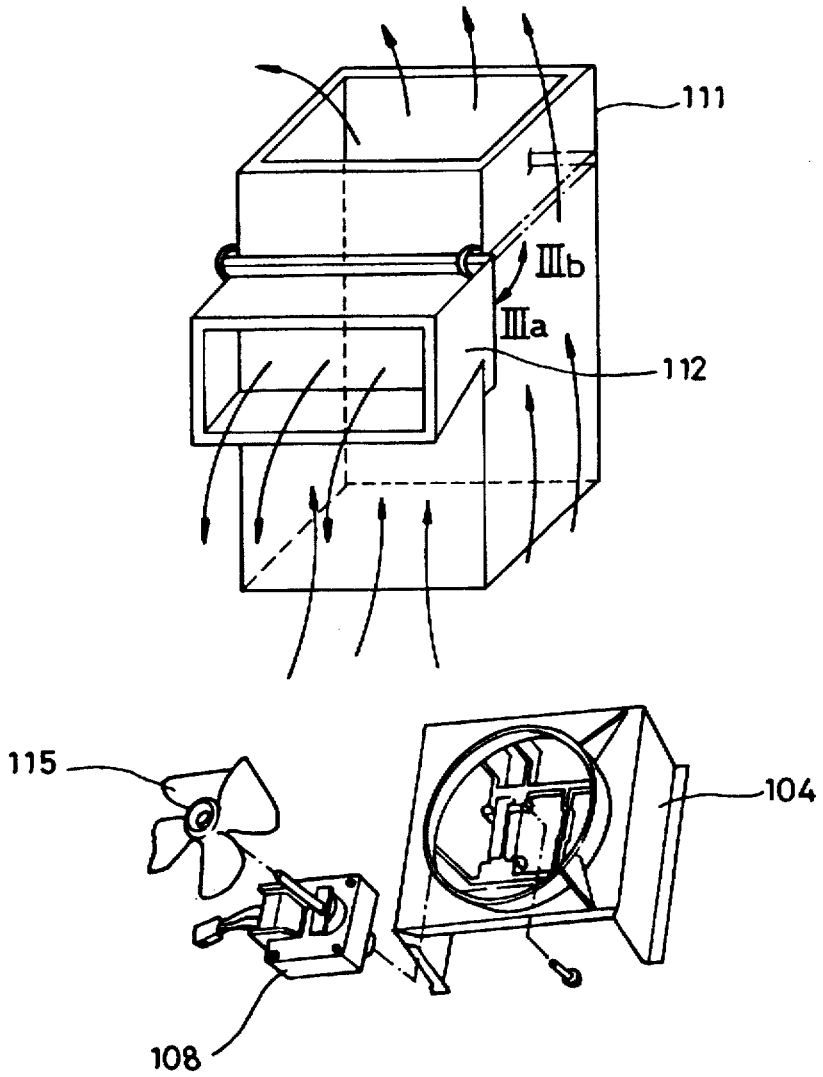
FIG. 3 is an exploded perspective diagram showing a cooling apparatus of the microwave oven according to the present invention.

As shown in FIGS. 2 and 3, a cooling fan having a motor 108 is mounted at an inner bottom portion of the electrical component mounting compartment 103 for cooling the magnetron 106 and the high voltage transformer 105 by rotating a fan blade 115 accommodated within a motor housing 104 in which the motor 108 is mounted.

As shown in FIG. 3, an air duct 111 is mounted above the fan blade 115 for guiding, in the upward direction of the electrical component mounting compartment 103 and the heating chamber 107, exterior air drawn into the electrical component mounting compartment 103 by the rotation of the cooling fan 108 through a suction inlet 110 defined in the bottom of the electrical component mounting compartment 103.

A duct guide 112 is pivotably disposed at one portion of the air duct 111.

A solenoid 114 for pivoting the duct guide 112 of the air duct 111 is connected to a portion of the air duct 111.

Figure 4:
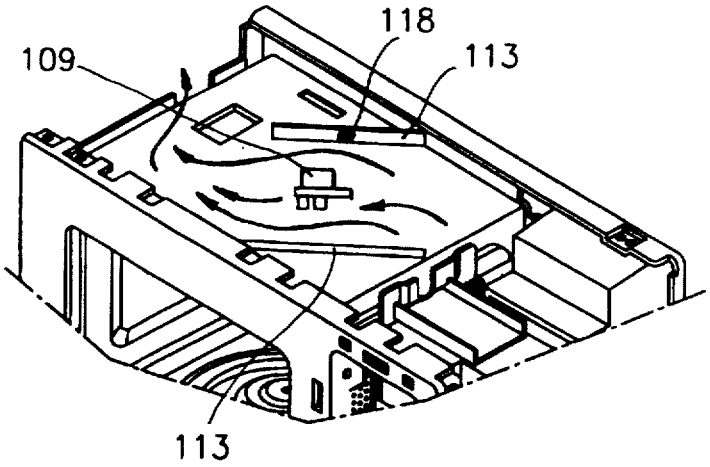
FIG. 4 is a perspective diagram showing the cooling air flowing paths of a thermopile adopted in the present invention.

As shown in FIG. 4, cooling air flowing guides 113 are attached on the upper surface of the heating chamber 107 to guide a cooling air flow onto the upper surface of the upper metal plate 107*a* of the heating chamber 107 towards the thermopile 109.

A thermostat 118 is mounted on a portion of the cooling air flow guide 113 for sensing the temperature around the thermopile 109.

The operation of the thermopile cooling apparatus for a microwave oven according to the present invention will be described with reference to the accompanying drawings.

First, when food is put in the heating chamber 107 to be cooked and a cooking program is selected, the magnetron 106 is oscillated and the food put in the heating chamber 107 begins to be heated.

At this time, the cooling fan 108 draws a cooling air from the outside, and the drawn-in air flows through the air duct 111 and cools the elements provided at the electrical component mounting compartment 103.

In more detail, when foodstuff is being cooked by microwave energy, the solenoid 114 connected to the air duct 111 is operated, and the duct guide 112 mounted in the air duct 111 is pivoted in the direction of the arrow IIIa, as shown in FIG. 3, and thereby the air blown into the air duct 111 is made to flow into the electrical component mounting compartment 103.

Meanwhile, when food is cooked by the heater 116, the heater 116 mounted inn the upper portion within the heating chamber 107 starts to be operated, and the food inside the heating chamber 107 is heated by the heat rays from the heater, and thereby the temperature of the thermopile 109 mounted on the upper surface of the upper metal plate 107*a* of the heating chamber 107 is increased.

Here, the solenoid 114 is operated, and the duct guide 112 is rotated in the direction of the arrow IIIb, and thereby the cooling air which is made to flow in to the inside of the air duct 111 from the outside by the rotation of the cooling fan 108 is directed to flow upwardly out of the air duct 111 into the space between the top of the heating chamber 107 and the casing metal toward the upper metal plate 107*a* of the heating chamber 107.

Therefore, the cooling air flown onto the upper surface of the upper metal plate 107*a* of the heating chamber 107, as shown by the arrows in FIG. 4, is directed toward the thermopile by the cooling air flow guides 113, and controls a temperature increase of the thermopile 109.

However, although the thermopile 109 is cooled by the cooling air, when due to a lengthened cooking time the temperature around the thermopile 109 is sensed to exceed 90° C. by the thermostat 118 provided at a portion of the cooling air flow guide 113, a switch(not shown) in the thermostat 118 is turned on, and a higher voltage (illustrated as $V_2$, in FIG. 6) is supplied to the cooling fan 108, and the higher voltage applied thereto causes the cooling fan 108 to be rotated at a higher speed (illustrated as RPM 1, in FIG. 5), and consequently a larger volume of cooled air is drawn in and directed to cool the thermopile 109, which controls a temperature increase of the thermopile 109.

Figure 5:
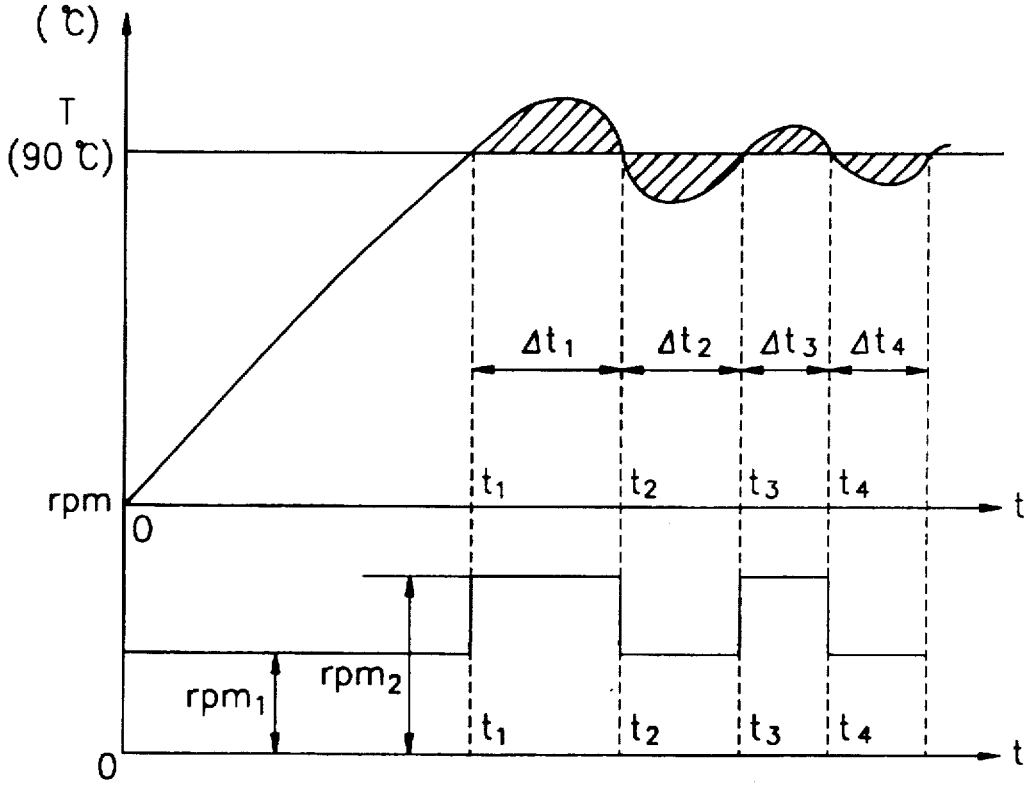
FIG. 5 is a graph for showing the relationship between the temperature of a thermostat and the rotation of a cooling fan according to the present invention.
Figure 6:
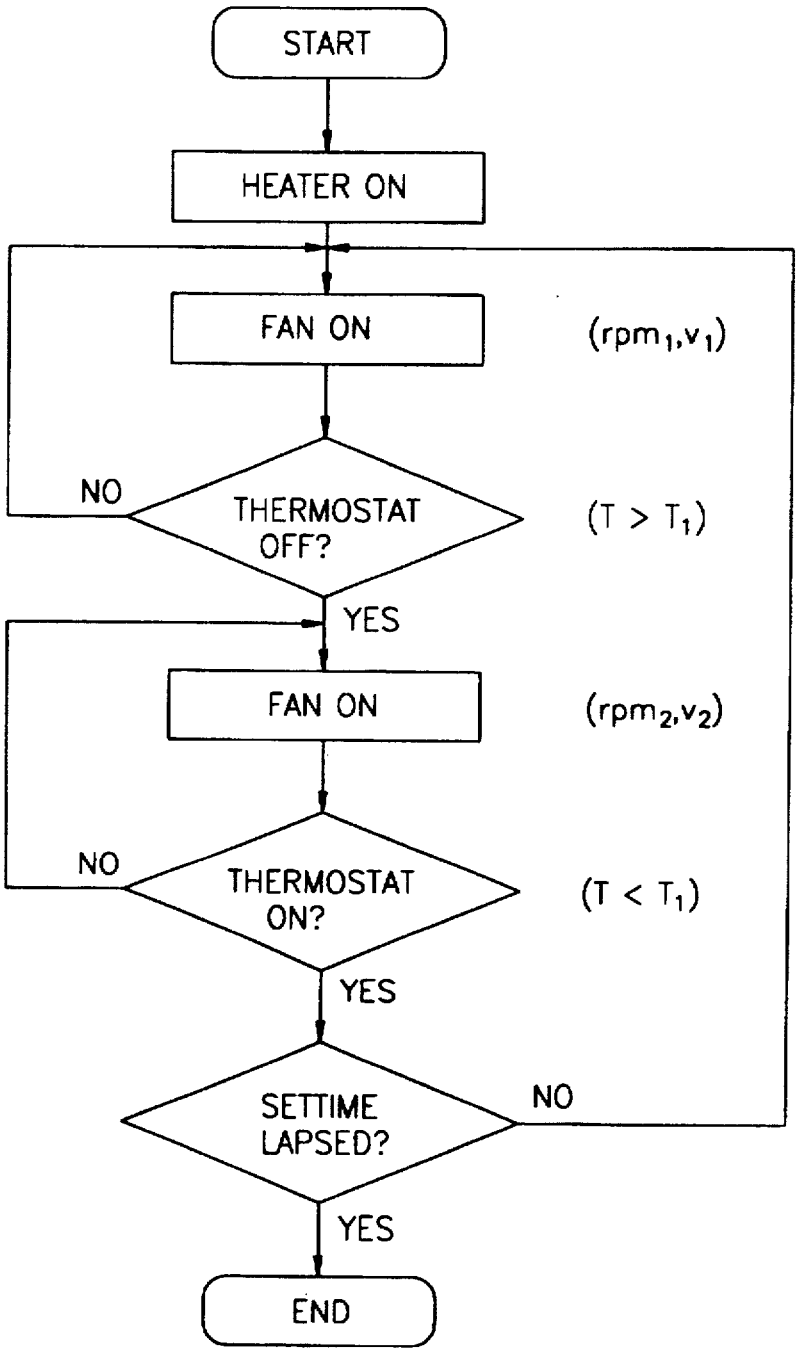
FIG. 6 is a flow chart of an operation method of a cooling apparatus according to the present invention.

In other words, as shown in the flow chart of FIG. 6, when the temperature T at a peripheral portion of the thermopile 109 is detected to exceed T1, that is, above 90° C. (between Δt1 and Δt3, as shown in FIG. 5), the switch in thermostat 118 is turned on, causing the higher voltage V2 to be supplied to the cooling fan motor 108 and then the fan blade 115 is rotated at a higher speed RPM2 by the cooling fan motor 108.

Contrarily, when the temperature T at a peripheral portion of the thermopile 109 is detected to be below T1, that is, below 90° C. (between Δt2 and Δt4, as shown in FIG. 5), the switch in the thermostat 118 is turned off so that the normal voltage $V_1$ is supplied to the cooling fan motor 108, and the cooling fan motor 108 is rotated at a normal speed(RPM 1, as shown in FIGS. 5 and 6).

As described in detail above, the apparatus and method for cooling the thermopile of a microwave oven cause the duct guide 112 in the air duct 111 to be positioned according to whether heat wave cooking or microwave cooking is being performed in order to prevent the thermopile 109 from being heated beyond a predetermined level, and are capable of controlling the temperature increase of the thermopile beyond a predetermined level by controlling the rotation speed RPM of the cooling fan motor 108, to provide a desired automatic cooking operation without being influenced by a temperature variation within the heating chamber 107.

What is claimed is:

1. An apparatus for cooling a thermopile provided at an upper surface of a heating chamber of a microwave oven, the apparatus comprising:

a cooling fan provided at a bottom portion of an electrical component mounting compartment in the microwave oven for supplying cooling air into the microwave oven;

an air duct in communication with the heating chamber and the electrical component mounting compartment, the air duct provided above the cooling fan, for selectively guiding outside air drawn in by the cooling fan through a suction inlet to an inside of the electrical component mounting compartment, or to an upper portion of the heating chamber; and a cooling air flow guide provided on the upper portion of the air duct, for guiding cooling air to the upper portion of the heating chamber toward the thermopile for maintaining a temperature of the thermopile at a predetermined level; and a thermostat provided at the cooling air flow guide for sensing a temperature around the thermopile.

2. The apparatus of claim 1, wherein said air duct means has a pivotable duct guide provided therein and operated by a solenoid for selectively guiding the cooling air to flow from the inside of the air duct to the inside of the electrical component mounting compartment or to the upper surface of the heating chamber.

3. The apparatus of claim 1, wherein the thermostat means is attached to the cooling air flow guide means for sensing a temperature around the thermopile.

4. A method of cooling a thermopile provided at an upper surface of a heating chamber of a microwave oven, the method comprising the steps of:

providing a cooling fan at the bottom portion of an electrical component mounting compartment in the microwave oven and supplying cooling air into the microwave oven;

supplying the cooling air from the cooling fan via an air duct which is in communication with a heating chamber and the electrical component mounting compartment, and locating the air duct above the cooling fan for selectively guiding outside air drawn in by the cooling fan through a suction inlet to an inside of the electrical component mounting compartment or to an upper portion of the heating chamber;

guiding the cooling air to the upper portion of the heating chamber toward the thermopile via a cooling air flow guide provided on the upper portion of the air duct and thereby maintaining the temperature of the thermopile at a predetermined level; and sensing the temperature around the thermopile with a thermostat provided at the cooling air flow guide.

5. In a microwave oven having a heating chamber, a cooling apparatus for a thermopile, comprising:

a thermopile provided at an upper portion of a heating chamber in the microwave oven;

cooling fan means provided at a bottom portion of an electrical component mounting compartment in the microwave oven for supplying cooling air into the microwave oven;

air duct means in communication with the heating chamber and the electrical component mounting compartment, the air duct means provided above the cooling fan means for selectively guiding outside air drawn in by the cooling fan means through a suction inlet to an inside of the electrical component mounting compartment, or to an upper portion of the heating chamber; and cooling air flow guide means provided on the upper portion of the air duct means, for guiding cooling air to the upper portion of the heating chamber toward the thermopile for maintaining a temperature of the thermopile to be at a predetermined level; and a thermostat means provided at the cooling air flow guide means for sensing a temperature around the thermopile.

6. In a microwave oven having a heating chamber, a cooling apparatus for a thermopile, comprising:

a thermopile provided at an upper portion of a heating chamber in the microwave oven;

a heater means provided in the heating chamber for convection heating;

cooling fan means provided at a bottom portion of an electrical component mounting compartment in the microwave oven for supplying cooling air into the microwave oven;

air duct means in communication with the heating chamber and the electrical component mounting compartment, the air duct means provided above the cooling fan means, for selectively guiding outside air drawn in the by the cooling fan means through suction inlet to an inside of the electrical component mounting compartment, or to an upper portion of the heating chamber; and cooling air flow guide means provided on the upper portion of the air duct means, for guiding cooling air to the upper portion of the heating chamber toward the thermopile for controlling the temperature of the thermopile to be at a predetermined level; and a thermostat means provided at the cooling air flow guide means for sensing a temperature around the thermopile.

7. A method for cooling a thermopile of a microwave oven, comprising the steps of:

introducing outside air into an electrical component mounting compartment in the microwave oven;

guiding outside air to an upper portion of a heating chamber in the microwave oven at which a thermopile is disposed;

detecting a temperature around the thermopile at the upper portion of the heating chamber; and providing a normal volume of cooling air to the thermopile when a temperature around the thermopile is detected to be below a predetermined level, and providing a larger than normal volume of cooling air to the thermopile when the temperature around the thermopile is detected to exceed the predetermined level.

* * * * *